US011879474B2

(12) United States Patent
Kristensen et al.

(10) Patent No.: US 11,879,474 B2
(45) Date of Patent: Jan. 23, 2024

(54) CENTRIFUGAL PUMP ASSEMBLY

(71) Applicant: GRUNDFOS HOLDING A/S, Bjerringbro (DK)

(72) Inventors: Martin Bang Kristensen, Bjerringbro (DK); Tom Jæger, Bjerringbro (DK); Patrick Pradel, Bjerringbro (DK); Joseph Arnold White, Bjerringbro (DK); Richard James Bibb, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 0 days.

(21) Appl. No.: 17/722,900

(22) Filed: Apr. 18, 2022

(65) Prior Publication Data

US 2022/0341436 A1 Oct. 27, 2022

(30) Foreign Application Priority Data

Apr. 19, 2021 (EP) ..... 21169212

(51) Int. Cl.

| | |
|---|---|
| ***F04D 29/22*** | (2006.01) |
| ***F04D 1/06*** | (2006.01) |
| ***F04D 17/12*** | (2006.01) |
| ***F04D 29/043*** | (2006.01) |
| ***F04D 29/08*** | (2006.01) |

(Continued)

(52) U.S. Cl.

CPC ..... *F04D 29/22* (2013.01); *F04D 1/063* (2013.01); *F04D 17/12* (2013.01); *F04D 29/043* (2013.01); *F04D 29/083* (2013.01); *F04D 29/4206* (2013.01); *F04D 29/584* (2013.01); *F04D 29/5806* (2013.01)

(58) Field of Classification Search

CPC ..... F04D 1/063; F04D 1/066; F04D 29/22; F04D 29/043; F04D 29/044; F05D 2260/36

See application file for complete search history.

(56) References Cited

U.S. PATENT DOCUMENTS

| | | | | |
|---|---|---|---|---|
| 10,808,703 | B2 * | 10/2020 | Mikkelsen | F04D 29/628 |
| 2007/0280825 | A1 * | 12/2007 | Chen | F04D 1/063 415/199.4 |
| 2011/0027077 | A1 * | 2/2011 | Brunner | F04D 13/10 415/198.1 |

FOREIGN PATENT DOCUMENTS

| | | | | |
|---|---|---|---|---|
| CN | 110701062 | A * | 1/2020 | |
| DE | 4444784 | A1 * | 6/1995 | D06F 39/085 |

(Continued)

*Primary Examiner* — Brian P Wolcott

(74) *Attorney, Agent, or Firm* — McGlew and Tuttle, P.C.

(57) ABSTRACT

A centrifugal pump assembly includes a pump head, a pump base defining a pump inlet and a pump outlet, a fluid outlet channel from the pump head to the pump outlet, impellers, defining an impeller fluid channel between an impeller inlet and outlet and connected with one of rotor shaft segments including a positive fit coupling for torque transfer between at least two rotor shaft segments, and one or more pump stage housing segments arranged between the pump base and the pump head. The pump stage housing segments have a structure defining a guide passage for receiving pumped fluid from the impeller outlet of the impellers and for guiding pumped fluid to the impeller inlet of another one of the impellers or to the pump head. The pump stage housing segments each have a structure defining at least a part of a wall section of the fluid outlet channel.

22 Claims, 8 Drawing Sheets

(51) Int. Cl.
*F04D 29/42* (2006.01)
*F04D 29/58* (2006.01)

(56) References Cited

FOREIGN PATENT DOCUMENTS

| | | | | |
|---|---|---|---|---|
| EP | 0667456 | A1 | | 8/1995 |
| EP | 3181908 | A1 | | 6/2017 |
| EP | 3670919 | A1 | | 6/2020 |
| GB | 732293 | A | * | 6/1955 |
| GB | 732293 | A | | 6/1955 |

* cited by examiner

CENTRIFUGAL PUMP ASSEMBLY

CROSS REFERENCE TO RELATED APPLICATIONS

This application claims the benefit of priority under 35 U.S.C. § 119 of European Application 21 169 212.4, filed Apr. 19, 2021, the entire contents of which are incorporated herein by reference.

TECHNICAL FIELD

The present disclosure is directed to centrifugal pumps, in particular to vertical multistage centrifugal pumps.

BACKGROUND

The shape and size of a pump assembly is designed to meet certain technical requirements and specifications. In particular, multi-stage centrifugal pumps like the pumps of the Grundfos CR series come in a wide range of sizes to cover a wide power range. The more pumping power is needed, the larger the pump is typically designed.

Typically, such pumps comprise a rotor axis that may extend vertically or horizontally. An electric motor drives a rotor shaft extending along a rotor axis into a pump housing enclosing at least one impeller stage. A pump base typically provides a stand and/or a mounting bracket to fix the pump on a floor or a wall. Inlet and outlet flanges for mounting the pump to a piping system may be part of the pump base and/or the pump housing. The pump housing is arranged between the motor and the pump base. The more pumping power or head is needed, the more impeller stages may be stacked along the rotor axis within the pump housing. Therefore, the axial length of the pump housing typically scales with the number of impeller stages. Depending on the maximum flow, the pump is supposed to be able to deliver, the radial extension of the impellers and the pump housing may be larger or smaller.

EP 3 181 908 A1 and EP 3 670 919 A1 describe strap solutions to fix the motor stool to the pump base, so that the pump housing is securely sandwiched between the motor stool and the pump base due to the clamping tension force conveyed by the straps or tie rods.

SUMMARY

The centrifugal pump assembly according to the present disclosure has a significantly reduced number of parts compared to known centrifugal pumps of comparable size. Manufacturing and assembling the parts is also simpler for the centrifugal pump assembly disclosed herein. Furthermore, maintenance, repair and overhaul is less complex. Finally, the risk of pump bearing faults is reduced.

According the present disclosure, a centrifugal pump assembly is provided comprising

- a pump head for connecting to or being integral with a motor stool and/or a motor housing,
- a pump base defining a pump inlet and a pump outlet,
- at least one fluid outlet channel for guiding pumped fluid from the pump head to the pump outlet,
- at least two rotor shaft segments coaxially aligned and extending along a rotor axis, wherein each of the rotor shaft segments comprises a first axial end facing away from the pump head and a second axial end facing away from the pump base,

- one or more impellers having a structure defining at least one impeller fluid channel extending from an impeller inlet to an impeller outlet, wherein each of the one or more impellers is fixed to or structurally integral with one of the rotor shaft segments, wherein the first axial end of said one rotor shaft segment comprises a positive fit coupling with the second axial end of another one of the rotor shaft segments for torque transfer between the at least two rotor shaft segments, and
- one or more pump stage housing segments arranged between the pump base and the pump head, wherein each of the pump stage housing segments have a structure defining a guide passage for receiving pumped fluid from the impeller outlet of one of the one or more impellers and for guiding pumped fluid to the impeller inlet of another one of the impellers or to the pump head, wherein the one or more pump stage housing segments each have a structure defining at least a part of a wall section of the at least one fluid outlet channel.

Thus, the fundamental configuration and setup of the centrifugal pump assembly disclosed herein differs significantly from previously known pump configurations. Firstly, the centrifugal pump assembly does not comprise a rotor shaft extending as a single part from the motor to the pump base. There are also no structures, such as straps or tie rods, needed to directly connect the pump head with the pump base for sandwiching the pump housing axially between the pump head and the pump base. Instead, according to the present disclosure, the rotor shaft as well as the pump housing is segmented in a modular fashion, with one pump stage housing segment per pump stage, i.e. impeller. The absence of length-dependent components is beneficial in terms of production cost, logistics and servicing, i.e. the pump length may be defined by the number of modules rather than a variety of components having an appropriate length. Given that the centrifugal pump assembly comprises $n \in \mathbb{N}$ pump stages, i.e. impellers, there may be n+1 or more rotor shaft segments, at least one of which connects the motor with another one of the rotor shaft segments. Said rotor shaft segment of the at least two rotor shaft segments which connects the motor with another one of the rotor shaft segments may be denoted as "motor shaft". Each pump stage housing segment is preferably positioned axially between two of the impellers, i.e. there may be n−1 pump stage housing segments in case of n pump stages, i.e. impellers. Although the centrifugal pump assembly disclosed herein is preferably a multistage centrifugal pump assembly, i.e. $n>1$, it should be noted that in case of a single stage centrifugal pump assembly, i.e. $n=1$, the pump stage housing segment may be integrated into the pump head, i.e. the pump stage housing segment may not be an extra part of the pump assembly. For $n>1$, at least one of the rotor shaft segments extends axially through a central opening in the pump stage housing segment(s) and is coupled to another rotor shaft segment by a positive fit coupling for torque transfer. It should be noted that each impeller may be part of a rotor shaft segment or vice versa, irrespective of whether the impeller is fixed to or structurally integral with the respective rotor shaft segment.

Optionally, the positive fit coupling between the rotor shaft segments is axially loose (there is some play in an axial direction). This means that the rotor shaft segments are not axially fastened to each other so that they can axially move relative to each other within limits. This facilitates the assembling process and allows for an individual bearing per pump stage in order to reduce wear and the risk of bearing faults. As explained later, there may an axial buffer room arranged between the rotor shaft segments and filled at least partly by a buffer medium and/or a spring element for damping the axial movement of the rotor shaft segments relative to each other.

Optionally, at least one of the one or more impellers is received within the pump base, wherein said one impeller is rotatably arranged within the pump base. Said one impeller may be denoted as the first stage impeller, which is located closest to the pump base and furthest away from the pump head. In a vertical setup of the centrifugal pump assembly, in which the pump base is the bottommost component, the first stage impeller is the bottommost impeller. By receiving the impeller, the pump base partly functions as a pump housing.

Optionally, each of the impellers and/or rotor shaft segments may define at least one rotating axial bearing surface facing towards the pump base and being arranged in sliding contact with a corresponding static axial bearing surface being defined by one of the one or more pump stage housing segments or the pump base and facing towards the pump head. This has the effect that the rotor shaft segments effectively do not transfer axial forces to each other via the positive fit coupling. As each stage comprises its own axial bearing, the axial forces do not add up to a total high axial force acting on a single axial pump bearing for the complete pump as known from the prior art. Commonly known single axial pump bearings are thus subject to wear and bearing faults, the risk of which is reduced by the inventive segmentation.

Optionally, each of the impellers and/or rotor shaft segments may define at least one rotating radial bearing surface facing radially outward and being arranged in sliding contact with a corresponding static radial bearing surface being defined by one of the pump stage housing segments or the pump base and facing radially inward. Similar to the axial bearings per pump stage, the radial bearings per pump stage further reduce the risk of wear and bearing faults. Alternatively, the bearing surfaces may be part of dedicated sleeve components fixed to the impellers and/or rotor shaft segments.

Optionally, at least one of the group comprising:

at least one of the pump stage housing segments, at least one of the impellers, the pump head, and the pump base may have a single integral additively manufactured structure. Additive manufacturing, also referred to as 3d-printing, in particular Selective Laser Melting or Laser Powder Bed Fusion (LPBF) with one or more metallic powders or any other suitable additive manufacturing technique, allows configuring and manufacturing metallic integral structures that conventional other manufacturing techniques do not allow. In particular, the configuration of internal fluid channels through integral structures is much less determined by manufacturing limitations if the integral structure is additively manufactured. For example, the pump stage housing segments, which define on the one hand the guide passage for receiving pumped fluid from one impeller and guiding it to the next impeller, and on the other hand at least a part of a wall section of the at least one fluid outlet channel, may be fluid-dynamically optimised in shape for guiding the fluid most efficiently. Also, the impeller configuration with fluid-dynamically optimised shape and arrangement of internal impeller fluid channels may benefit from being additively manufactured to avoid compromising fluid-dynamic performance for conventional manufacturability. Furthermore, the pump head and/or the pump base may preferably be additively manufactured as an integral structure. Additive manufactured components are particularly useful to reduce the number of pump components to a minimum. For example, a conventional vertical Grundfos CR-pump may comprise more than 100 separate parts and components, whereas the centrifugal pump assembly disclosed herein having similar size may comprise less than 20 separate components. A further advantage of additive manufactured parts and components may be a reduced weight and material consumption.

Optionally, the one or more pump stage housing segments each may have a structure defining the wall section of the at least one fluid outlet channel, wherein the wall section fully circumferences (circumferentially enclosing) fluid pumped through the at least one fluid outlet channel. This means that there is no further sleeve or similar needed to establish a closed fluid outlet channel, through which pumped fluid returns from the pump head towards the pump outlet. The pump stage housing segments may be sealingly connected to each other, so that no fluid leaks to the outside where the pump stage housing segments are connected to each other.

Optionally, the centrifugal pump assembly may further comprise a fluid outlet channel sleeve circumferentially enclosing the one or more pump stage housing segments, wherein the one or more pump stage housing segments each have a structure defining a part of the wall section of the at least one fluid outlet channel, wherein the part of the wall section and the fluid outlet channel sleeve complement each other to define the at least one fluid outlet channel. A fluid outlet channel sleeve may be particularly beneficial in case of a plurality of pump stages, because the more connections between pump stage housing segments are present, the more sealing elements are needed and the higher is the risk of leakage. Therefore, a fluid outlet channel sleeve may reduce the number of needed sealing elements and thus may reduce the risk of leakage. The fluid outlet channel sleeve may comprise a first axial end being sealingly connected to the pump head and a second axial end being sealingly connected to the pump base. It should be noted that the fluid outlet channel sleeve may be free of any axial force transmission or structural function for holding pump head and pump base together. So, the fluid outlet channel sleeve does preferably not serve as a strap or tie rod.

Optionally, the one or more pump stage housing segments may each comprise a first mechanical coupling at a first axial segment end facing away from the pump head and a second mechanical coupling at a second axial segment end facing away from the pump base, wherein the one or more pump stage housing segments is coupled to the pump base or another pump stage housing segment by the first mechanical coupling, and wherein the one or more pump stage housing segments is coupled to the pump head or another pump stage housing segment by the second mechanical coupling. This facilitates the modularly segmented setup of the pump housing, because the one or more pump stage housing segments may be assembled together in any order. The first and second mechanical couplings may be used to hold the pump assembly axially together.

Optionally, the first mechanical coupling is formed as a corresponding coupling counterpart to the second mechanical coupling for being releasably coupled to a second coupling of another pump stage housing segment. This facilitates the modularly segmented setup of the pump housing and gives easy access to the components for maintenance, repair and overhaul. It is also very easy to replace individual pump stage housing segments if needed.

Optionally, the first mechanical coupling and/or the second mechanical coupling of the one or more pump stage housing segments predefine one or more distinct rotational mounting positions of said one or more pump stage housing segments. This is particularly useful if there is more than one fluid outlet channel defined in parallel by the pump stage housing segments and to make sure that each fluid outlet channel is well defined in said one or more distinct rotational mounting positions.

Optionally, the first mechanical coupling and the second mechanical coupling may define corresponding coupling counterparts of a bayonet coupling. A bayonet coupling has the advantage that it defines distinct rotational mounting positions and may not require tools for assembly. Furthermore, a bayonet coupling may provide for a well-defined sealing pressure between connected pump stage housing segments and/or between a pump stage housing segment and the pump head/base.

Optionally, the centrifugal pump assembly may further comprise at least one sealing element for sealing the at least one fluid outlet channel. For example, a sealing ring, e.g. an O-ring, may be used to seal the connection between pump stage housing segments and/or between a pump stage housing segment and the pump head/base. Preferably, the at least one sealing element is positioned radially outward from the at least one fluid outlet channel in order to prevent leakage to the outside.

Optionally, the pump head may define a reverse channel for receiving pumped fluid from one of the one or more impellers and redirecting the pumped fluid to the at least one fluid outlet channel section of one of the pump stage housing segments being coupled to the pump head. Given that the centrifugal pump assembly comprises $n \in \mathbb{N}$ pump stages, i.e. impellers, the reverse channel receives pumped fluid from the impeller outlet of the $n^{th}$ impeller, i.e. the last or topmost impeller of a vertical stack of n impellers. The reverse channel redirects the pumped fluid to the part of the fluid outlet channel defined by the $(n-1)^{th}$ pump stage housing segment, i.e. to the last or topmost pump stage housing segment of a vertical stack of n−1 pump stage housing segments.

Optionally, the pump head may define a guide passage for receiving pumped fluid from the impeller outlet of the last impeller and for guiding pumped fluid to the fluid outlet channel. So, the guide passage may be a part of the reverse channel that is beneficial for the pump effectiveness of the last impeller. The guide passage of the pump head may be shaped identical or similar to the guide passage of the pump stage housing segment(s).

Optionally, the pump head may be connected to or integral with the motor housing and the reverse channel may extend through the motor housing in thermal contact with heat-generating components of the motor, so that the pumped fluid cools the heat-generating components of the motor. This is particularly useful to reduce the number of parts and components and to improve the pump performance and durability. In particular, an additive manufactured pump head being integral with a motor housing may be configured to comprise one or more cooling channels in thermal contact with heat-generating components of the motor. Obviously, the pumped fluid is only effective as a heat sink if it is cool enough, e.g. cold water.

Optionally, in particular in combination with an axially loose positive fit coupling between the rotor shaft segments, there may be an axial buffer room provided between the first axial end of the rotor shaft segment of the one or more impellers and the second axial end of another one of the rotor shaft segments being positively coupled thereto for torque transfer between said coupled rotor shaft segments. In combination with an axial bearing for each pump stage, such an axial buffer room may further facilitate that little or no axial forces are transferred from one rotor shaft segment to the next rotor shaft segment. Thereby, the risk of wear and bearing faults may be reduced.

Optionally, the axial buffer room may be at least partly filled by a buffer medium. The buffer medium may be compressible, e.g. air, a gas, a flexible material, such as an elastomer, or a combination thereof. Alternatively, or in addition, the buffer medium may comprise a liquid, e.g. the pumped fluid, wherein the liquid is forced to escape through one or more narrow paths upon axial pressure on the axial buffer room. The buffer medium dampens undesirable axial motion of the rotor shaft segments relative to each other and may avoid noise resulting from axial impacts between rotor shaft segments.

Optionally, the pump base may define a fluid suction inlet channel extending from the pump inlet to a suction eye, wherein the suction eye is arranged coaxial with the rotor axis and surrounds laterally a rotor shaft segment of one of the one or more impellers. Given that the centrifugal pump assembly comprises $n \in \mathbb{N}$ pump stages, i.e. impellers, the suction eye surrounds laterally the rotor shaft segment of the first impeller, i.e. the bottommost impeller of a vertical stack of n impellers. Preferably, the rotor shaft segment extends from the impeller axially into the suction eye of the pump base.

Optionally, the pump base may define a tubular element arranged coaxially within the suction eye for receiving the rotor shaft segment of said impeller, wherein the tubular element provides at least one static radial bearing surface in sliding contact with the rotor shaft segment of said impeller. Preferably, the impeller inlet extends annularly around the rotor shaft segment, and the tubular element is positioned radially between the impeller inlet and the rotor shaft segment. The at least one static radial bearing surface is preferably an inner surface of the tubular element, and an outer surface of the tubular element is preferably surrounded by fluid being sucked into the suction eye. The tubular element may be supported within the suction eye by radially extending webs. The tubular element and the webs may preferably be integral part of the pump base, preferably as part of an integral additively manufactured structure. As the webs extend across the fluid flow path through the suction eye, they may be shaped in a way that they induce as little fluid-dynamic resistance and turbulence as possible.

Optionally, the centrifugal pump may be free of a shaft extending from the motor stool to the pump base, and/or tie rods or straps for holding the pump head and the pump base together.

Optionally, the impeller outlet may face away from the pump base and an inlet of the guide passage faces towards the pump base, wherein the inlet of the guide passage is arranged to receive pumped fluid from the impeller outlet. Preferably, the fluid enters the impeller inlet in the axial direction towards the pump head and exits the impeller outlet in the axial direction towards the pump head, wherein the impeller outlet is arranged radially outward from the impeller inlet and has a larger axial distance from the pump base than the impeller inlet. The pumped fluid thus preferably follows a fluid-dynamically optimized flow path, e.g. smoothly S-shaped, in the axial direction within the impeller. Preferably, the guide passage within the pump stage housing segment may define a corresponding fluid-dynamically optimized flow path, e.g. inverted smoothly S-shaped, radially inwards from the radially outward inlet of the guide passage to a radially inward outlet of the guide passage that feeds the impeller inlet of the subsequent impeller. Thus, the pumped fluid enters and exits the impeller essentially in the axial direction. This is fluid-dynamically beneficial, but requires a more complex fluid channel configuration. Therefore, the impeller(s) and/or pump stage housing segment(s) are preferably manufactured additively as an integral structure with internal fluid channels.

Optionally, all of the impellers and/or pump stage housing segments may be identical in shape, size and material. This reduces the diversity of parts and simplifies assembly and spare part management. It also allows, within certain ranges, quick and easy adapting of the size of the pump assembly by adding or reducing pump stages and thus reduces the number of pump models to be offered by a pump manufacturer.

The segmented modular configuration of the centrifugal pump assembly disclosed herein allows for a higher degree of variability and customisation to specific applications and customer needs. Fewer parts and components also require fewer spare parts. Furthermore, additively manufacturable spare parts may not need to be held on stock, but may be produced on demand. There is also no need to replace the complete centrifugal pump assembly if it is sufficient to replace only a defect pump stage.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

Embodiments of the present disclosure will now be described by way of example with reference to the following figures of which.

DETAILED DESCRIPTION

Figure 1:
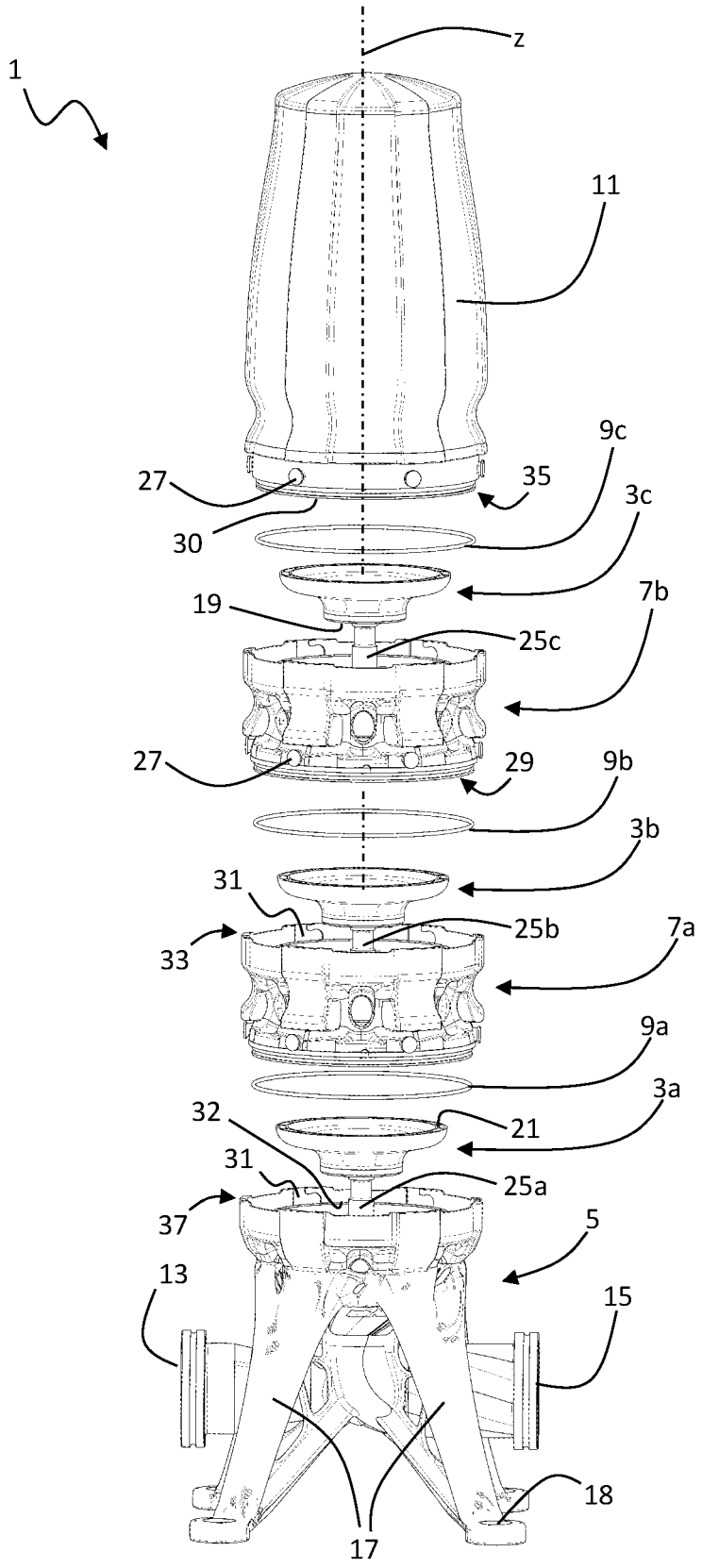
FIG. 1 is an exploded perspective view of an embodiment of a centrifugal pump assembly according to the present disclosure.

FIG. 1 shows a centrifugal pump assembly 1 in the form of a vertical multistage centrifugal pump assembly comprising a vertical rotor axis z and n=3 pump stages, i.e. three impellers 3*a-c*. The centrifugal pump assembly 1 comprises a pump base 5, three impellers 3*a-c*, two pump stage housing segments 7*a,b*, three sealing elements 9*a-c* and a pump head 11, i.e. in total ten separate parts (without counting parts of a motor and motor control electronics). The number of parts of the centrifugal pump assembly 1 shown in FIG. 1 is significantly reduced compared to a conventional multistage centrifugal pump assembly comprising three pump stages. Except for the sealing elements 9*a-c*, one, some or all of the other seven parts shown in FIG. 1 are preferably additively manufactured.

The pump base 5 is an integral additively manufactured structure, preferably of a metallic material. The pump base 5 defines a pump inlet 13 and a pump outlet 15. The pump inlet 13 and the pump outlet 15 are arranged coaxially facing into opposite horizontal directions, so that the centrifugal pump assembly 1 may be installed into a straight pipe section. The pump base 5 further defines a stand structure with feet 17 standing on a floor or ground. The feet 17 comprise openings 18 for fastening the pump base 5 to the ground by means of fasteners, e.g. screws. An upper portion of the pump base 5 defines a reception structure for receiving the first impeller 3*a*. Said upper portion of the pump base 5 partly functions as a pump housing. More details of the pump base 5 can be seen in FIG. 6.

The impellers 3*a-c* each have a structure defining several impeller fluid channels extending from an impeller inlet 19 to an impeller outlet 21. The impeller inlet 19 faces towards the pump base 5, i.e. downward (better visible in FIG. 4*b*). The impeller outlet 21 faces towards the pump head 11, i.e. upward. The impeller outlet 21 is positioned radially more outward than the impeller inlet 19. The impeller fluid channels within the impellers 3*a-c* are separated from each other by impeller vanes 23 (better visible in FIGS. 3 and 4*a*). Furthermore, the impellers 3*a-c* each form, as in integral structure, a rotor shaft segment 25*a-c* extending pre-dominantly in the axial direction towards the pump base 5, i.e. downward. The rotor shaft segment 25*a* of the first, i.e. bottommost, impeller 3*a* extends into a suction eye 51 of the pump base 5 (better visible in FIG. 6). The rotor shaft segments 25*b,c* of the other impellers 3*b,c* extend into the respective pump stage housing segments 7*a,b* positioned axially below the respective impeller 3*b,c* (better visible in FIG. 3).

A first pump stage housing segment 7*a* is arranged axially above the first impeller 3*a*, and a second pump stage housing segment 7*b* is arranged axially above the second impeller 3*a*. Both pump stage housing segments 7*a,b* are essentially identical in material and shape. As shown in more detail in FIG. 2*a*, they each comprise a first mechanical coupling 27 at a first axial segment end 29 facing towards the pump base 5 and a second mechanical coupling 31 at a second axial segment end 33 facing away from the pump base 5. The pump head 11 comprises an identical first mechanical coupling 27 at a (lower) pump head end 35 facing towards the pump base 5. Analogously, the pump base 5 comprises an identical second mechanical coupling 31 at an (upper) pump base end 37 facing towards the pump head 11. The first mechanical coupling 27 is a male component of a bayonet coupling in form of radially outward rivet-like protrusions. In the shown example, there are six radially outward rivet-like protrusions evenly distributed circumferentially. The second mechanical coupling 31 is a corresponding female component of a bayonet coupling in form of hook-shaped slots at a radial inner side for receiving a head of a rivet-like protrusion of the first mechanical coupling 27. The first mechanical coupling 27 and the second mechanical coupling 31 are locked to each other by pushing the rivet-like protrusions axially into the hook-shaped slots up to a mechanical stop and a subsequent twist around the rotor axis z to move the rivet-like protrusions into a defined locking position.

Figure 2A:
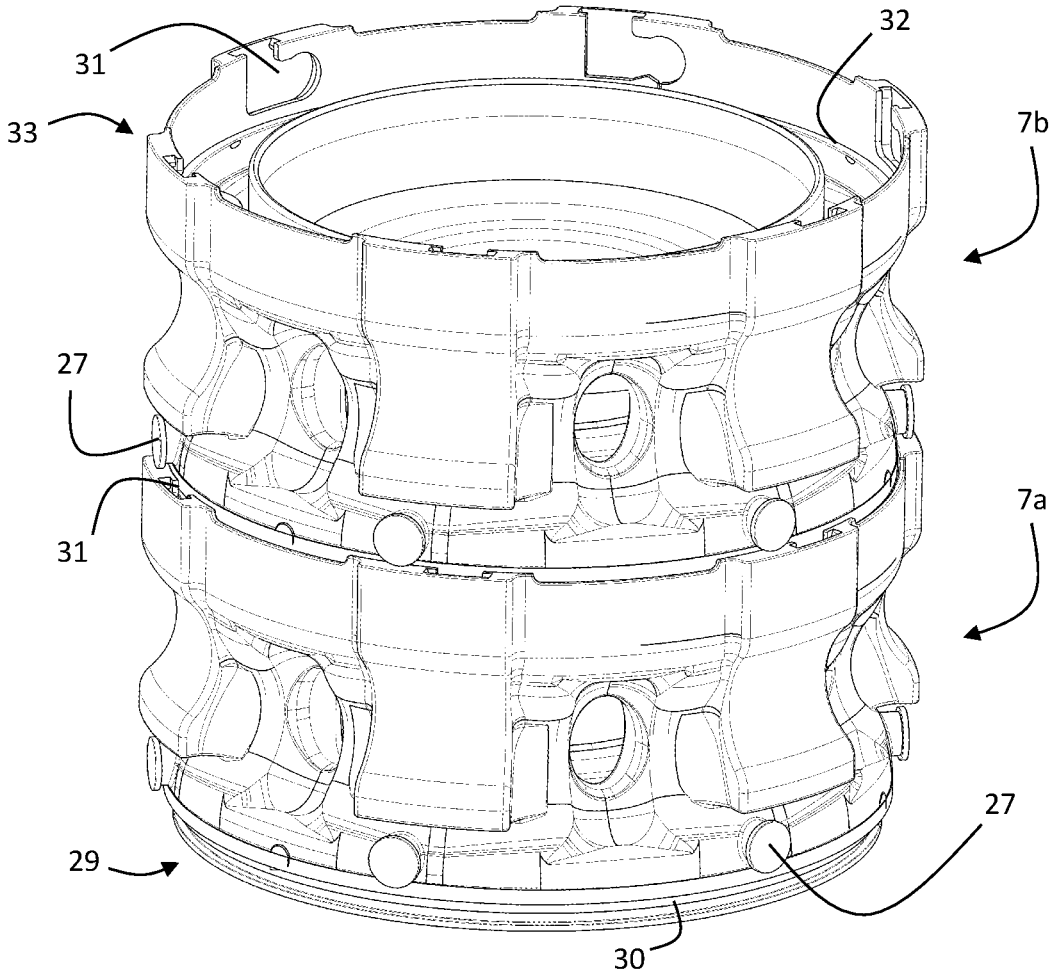
FIGS. 2*a* and 2*b* are perspective views showing a mechanical coupling mechanism between pump stage housing segments of an embodiment of a centrifugal pump assembly according to the present disclosure.

In the locking position, the first sealing element 9*a* is sealingly squeezed between the pump base 5 and the (lower) first axial segment end 29 of the (bottommost) first pump stage housing segment 7*a*. Analogously, the second sealing element 9*b* is sealingly squeezed between the first pump stage housing segment 7*a* and the (lower) first axial segment end 29 of the (topmost) second pump stage housing segment 7*b*. Finally, the third sealing element 9*c* is sealingly squeezed between the second pump stage housing segment 7*b* and the (lower) pump head end 35. Thereby, the fluid channels within the centrifugal pump assembly 1 are completely sealed to prevent leakage. As shown in FIG. 2*a*, the pump stage housing segments 7*a* comprise a sealing groove 30 at the (lower) first axial segment end 29, wherein the sealing elements 9*a-c* are positioned at least partly within the sealing groove 30. The pump head 11 also comprises a sealing groove 30 (see FIG. 1) at the (lower) pump head end 35. Before coupling the pump stage housing segments 7*a,b* to each other or to the pump head 11 or pump base 5, the sealing elements 9*a-c* protrude at least partially radially outward out of the sealing groove 30. When the pump stage housing segments 7*a,b* are coupled to each other or to the pump head 11 or pump base 5, the sealing elements 9*a-c* are sealingly squeezed radially inward by a radial inner surface 32 of the other pump stage housing segment 7*a,b* or pump base 5 (see FIG. 5). Alternatively, or in addition, the sealing elements 9*a-c* may be arranged to be squeezed axially between the components.

Due to the six-fold rotational symmetry of the mechanical couplings 27, 31, there are six distinct rotational mounting positions which may serve as the locking position. Preferably, each of the pump stage housing segments 7*a,b* comprises a six-fold rotational symmetry so that the six distinct rotational mounting positions may be indistinguishable from each other. This facilitates the assembly procedure and reduces the risk of incorrect assembling. A skilled person will readily understand that any m-fold rotational symmetry may be applicable to achieve this, wherein $m \geq 2$.

Figure 2B:
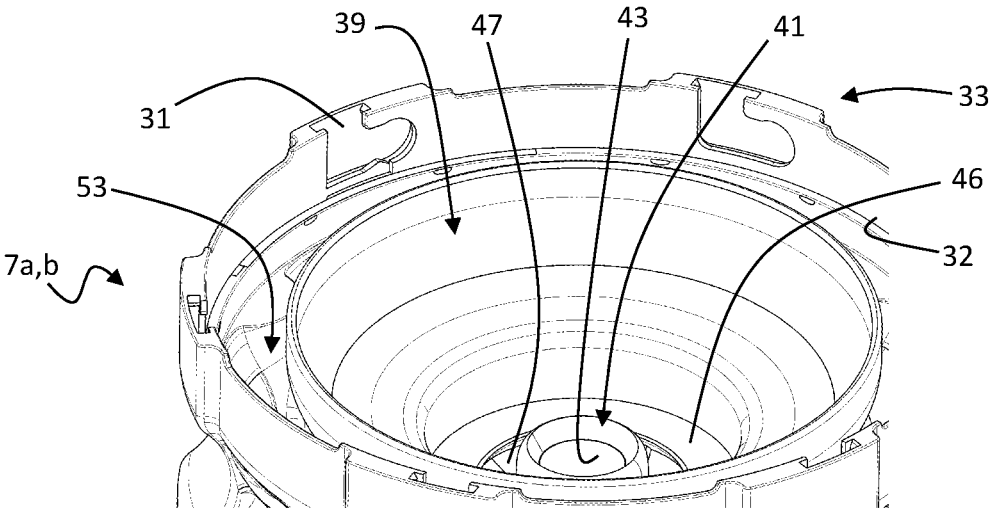

FIG. 2*b* shows that the pump stage housing segments 7*a,b* comprises an impeller receptacle 39 that is open towards the (upper) second first axial segment end 33. The impeller receptacle 39 is configured to completely receive one of the impellers 3*b,c*. The pump stage housing segment 7*a,b* comprises a tubular element 41 arranged in the centre for receiving the rotor shaft segment 25*a-c* of said impeller 3*b,c*.

As shown in FIG. 2*b*, each pump stage has its own axial and radial bearing. The tubular element 41 defines a static radial inner bearing surface 43. When the centrifugal pump assembly 1 is completely assembled, the static radial inner bearing surface 43 is in low-friction sliding contact with a corresponding rotating radial outer bearing surface 45 of the rotor shaft segment 25*a-c* (see FIGS. 3 and 4*b*). Furthermore, the pump stage housing segment 7*a,b* defines a static annular axial bearing surface 46 facing towards the pump head 11. When the centrifugal pump assembly 1 is completely assembled, the static axial bearing surface 46 is in low-friction sliding contact with a corresponding downward-facing, i.e. towards the pump base 5, rotating axial bearing surface 48 of the impeller 3*b,c* (see FIGS. 3 and 4*b*).

The pump base 5, when seen from the (upper) pump base end 37, looks essentially identical to FIG. 2*b*. The pump base 5 also comprises an impeller receptacle 39 that is open towards the (upper) pump base end 37. The impeller receptacle 39 of the pump base 5 is configured to completely receive the first impeller 3*a*. The pump base 5 comprises a tubular element 41 arranged coaxially within a suction mouth 51 (see FIG. 6) for receiving the rotor shaft segment 25*a* of the first impeller 3*a*. The tubular element 41 is supported within the suction eye 51 by radially extending webs 42 (see FIGS. 3, 6 and 7). The tubular element 41 of the pump base 5 defines a static radial inner bearing surface 43. When the centrifugal pump assembly 1 is completely assembled, the static radial inner bearing surface 43 is in low-friction sliding contact with a corresponding rotating radial outer bearing surface 45 of the rotor shaft segment 25*a* of the first impeller 3*a* (see FIGS. 3, 4*b* and 6). Furthermore, the pump base 5 defines a static annular axial bearing surface 46 facing towards the pump head 11. When the centrifugal pump assembly 1 is completely assembled, the static axial bearing surface 46 is in low-friction sliding contact with a corresponding downward-facing, i.e. towards the pump base 5, rotating axial bearing surface 48 of the first impeller 3*a* (see FIGS. 3 and 4*b*). The pump base 5 also squeezes the first sealing element 9*a* radially inward into the sealing groove 30 of the first pump stage housing segment 7*a*.

It should be noted that "low-friction sliding contact" shall mean herein that a thin lubricating film of pumped fluid may be placed between the bearing surfaces. The bearing surfaces may comprise a different material for reducing friction and wear. For example, the bearing surfaces may be coated, treated and/or mechanically processed. In case of the pump stage housing segments 7*a,b* and/or the impellers 3*a-c* being additively manufactured, multimaterial additive manufacturing (MMAM) with or without post-processing may be used to produce the bearing surfaces 43, 45, 46, 48 with a different material than the rest of the respective component it belongs to.

Radially between the tubular element 41 and the static axial bearing surface 46, there is an annular fluid outlet of a guide passage 47 defined by the internal structure of the pump stage housing segment 7*a,b*. The impeller 3*a-c* located within the impeller receptacle 39 comprises an impeller inlet 19 (see FIG. 4*b*) which receives pumped fluid from the fluid outlet of the guide passage 47.

Radially outward from the impeller receptacle 39, the pump stage housing segments 7*a,b* each have a structure defining a section of a fluid outlet channel 53. The pumped fluid is guided from the pump head 11 through the fluid outlet channel 53 downward towards the pump outlet 15. Due to the chosen six-fold rotationally symmetric configuration of the pump stage housing segment 7*a,b* of the shown embodiment, there are six fluid outlet channels 53 circumferentially distributed around the impeller receptacle 39. In the shown embodiment, the fluid outlet channels 53 are separate from each other before they combine in the suction mouth 51.

Figure 3:
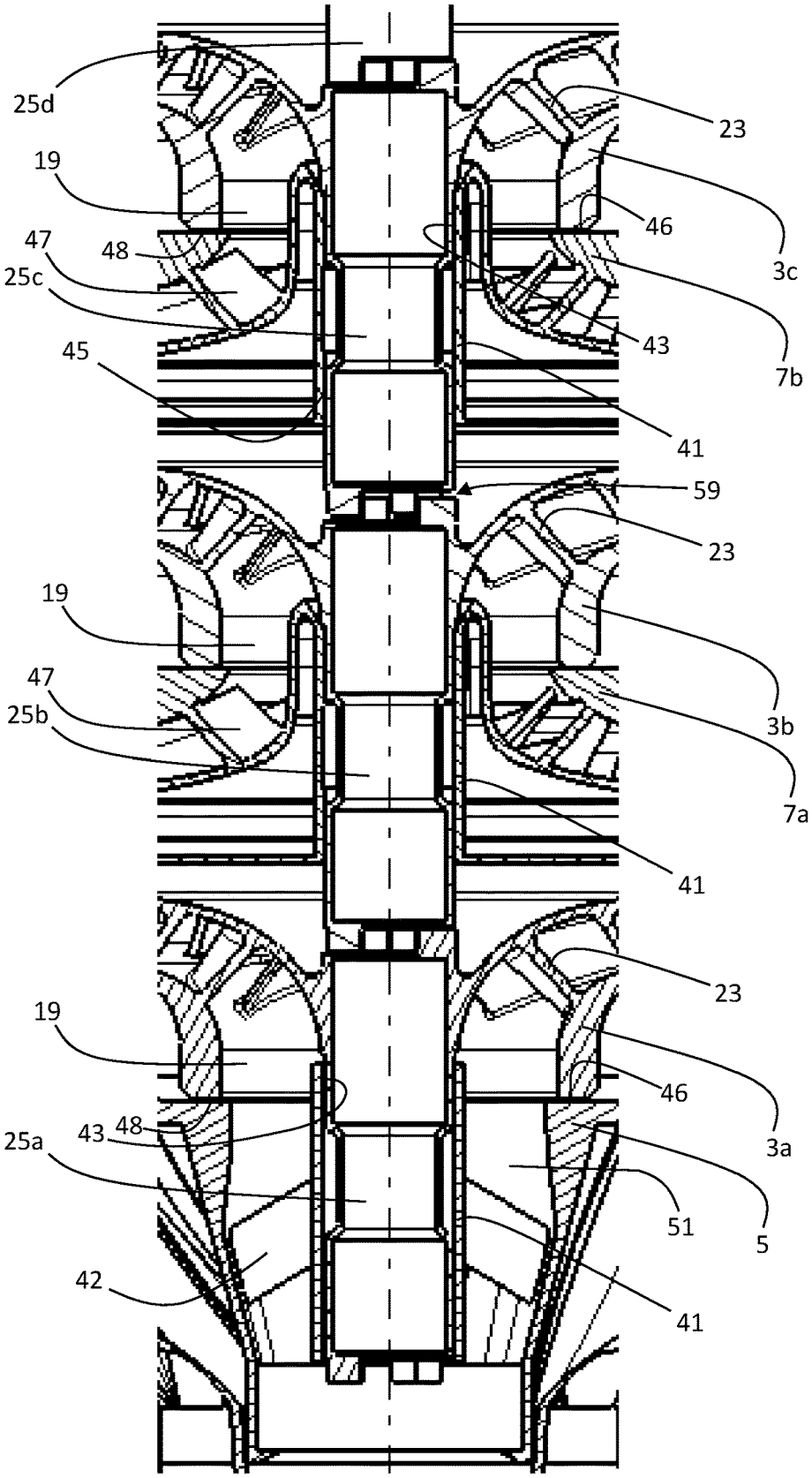
FIG. 3 is a longitudinal sectional view of three rotor shaft segments in an embodiment of a centrifugal pump assembly according to the present disclosure.

FIG. 3 shows the rotor shaft segments 25*a-d* when the centrifugal pump assembly 1 is completely assembled. The impellers 3*a-c* are arranged within their associated impeller receptacle 39 such that the impeller inlet 19 receives fluid being guided by the guide passage 47 essentially vertically upward. The rotor shaft segments 25*a-c* extend through the tubular elements 41. The rotor shaft segments 25*a-d* are coupled to each other by a positive fit in form of a claw coupling (see FIG. 4*b*). The positive fit coupling is axially loose, but allows a torque transfer. A (lower) first axial end 55 of the rotor shaft segment 25*a-d* comprises a positive fit coupling with an (upper) second axial end 57 of another one of the rotor shaft segments 25*a-d* for torque transfer between the rotor shaft segments 25*a-d*. The coupling portion at the (lower) first axial end 55 to the rotor shaft segment 25*a* of the first impeller 3*a* is not used. The coupling portion at the (lower) first axial end 55 of the rotor shaft segment 25*b* of the second impeller 3*b* engages with the (upper) second axial end 57 of the rotor shaft segment 25*a* of the first impeller 3*a*. The coupling portion at the (lower) first axial end 55 of the rotor shaft segment 25*c* of the third impeller 3*c* engages with the (upper) second axial end 57 of the rotor shaft segment 25*b* of the second impeller 3*b*. At least one of the rotor shaft segment 25*a-d* is not integral part of one of the impellers 3*a-c*. This is here a fourth rotor shaft segment 25*d* that extends towards the motor. The coupling portion at the (lower) first axial end 55 of the fourth rotor shaft segment 25*d* engages with the (upper) second axial end 57 of the rotor shaft segment 25*c* of the third impeller 3*c*. The torque of the motor is thereby transferred from the fourth rotor shaft segment 25*d* to other rotor shaft segments 25*a-c*.

There is a small axial buffer room 59 provided between the first axial end 55 of the rotor shaft segment 25*a-d* the second axial end of the next rotor shaft segment 25*a-c*. The axial buffer room 59 is at least partly filled by a buffer medium, e.g. air, pumped fluid, an elastomer, or a combination thereof.

Figure 4A:
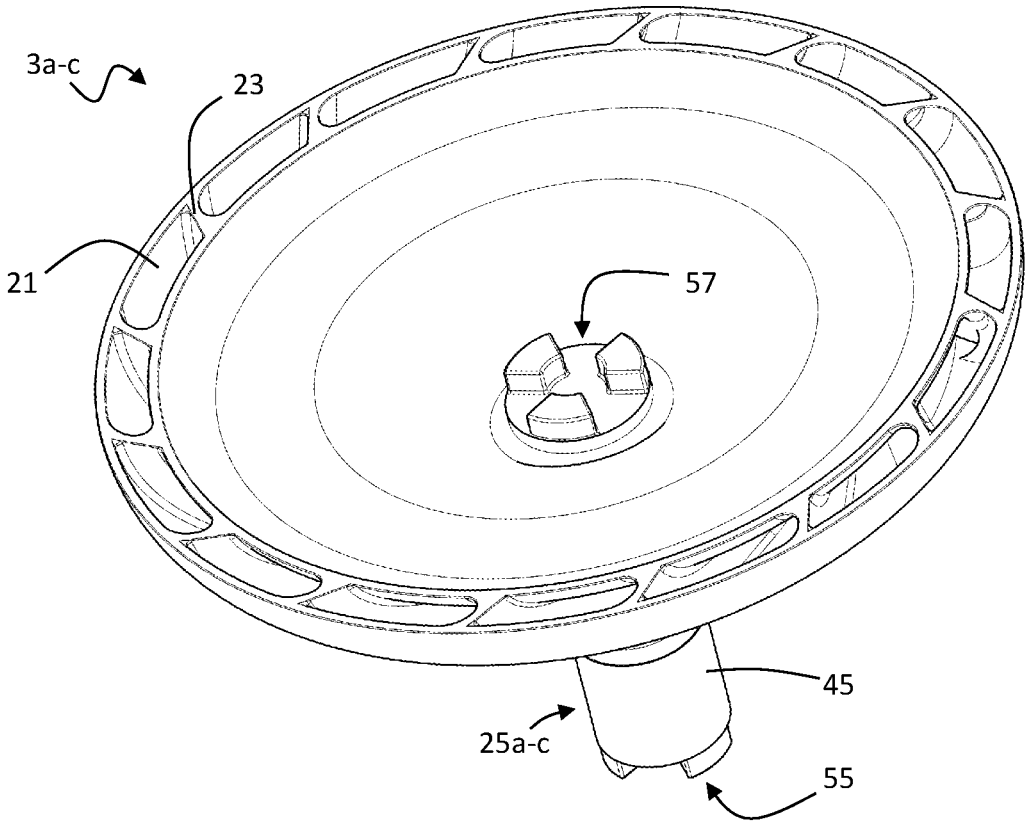
FIGS. 4*a* and 4*b* are perspective views showing an impeller (including a rotor shaft segment) of an embodiment of a centrifugal pump assembly according to the present disclosure.
Figure 4B:
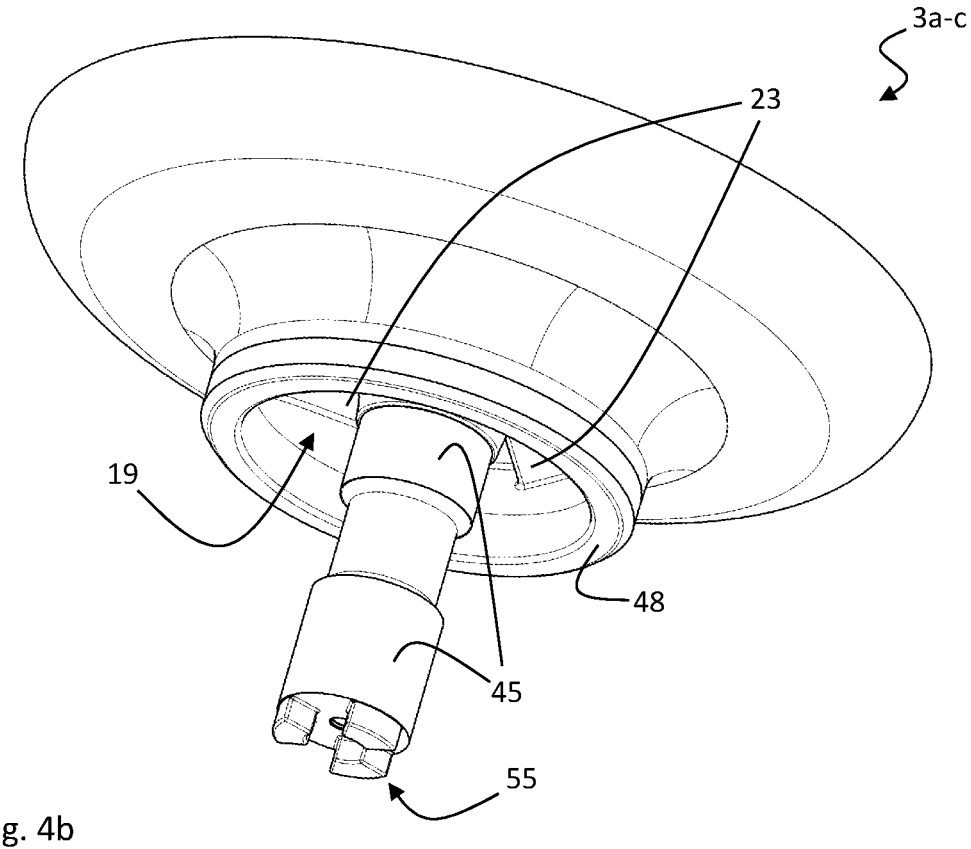

FIG. 4*a,b* show the impeller 3*a-c* in more detail. The impeller 3*a-c* has a structure defining impeller fluid channels spiralling radially outward and S-shaped upward from the impeller inlet 19 to the impeller outlet 21. The impeller inlet 19 faces towards the pump base 5, i.e. downward. The impeller outlet 21 faces towards the pump head 11, i.e. upward. The impeller fluid channels within the impellers 3*a-c* are separated from each other by 16 impeller vanes 23. When the centrifugal pump assembly 1 is completely assembled, a fluid inlet of the guide passage 47 within the pump stage housing segment 7*a,b* receives from the impeller outlet 21 fluid flowing essentially vertically upward.

Figure 5:
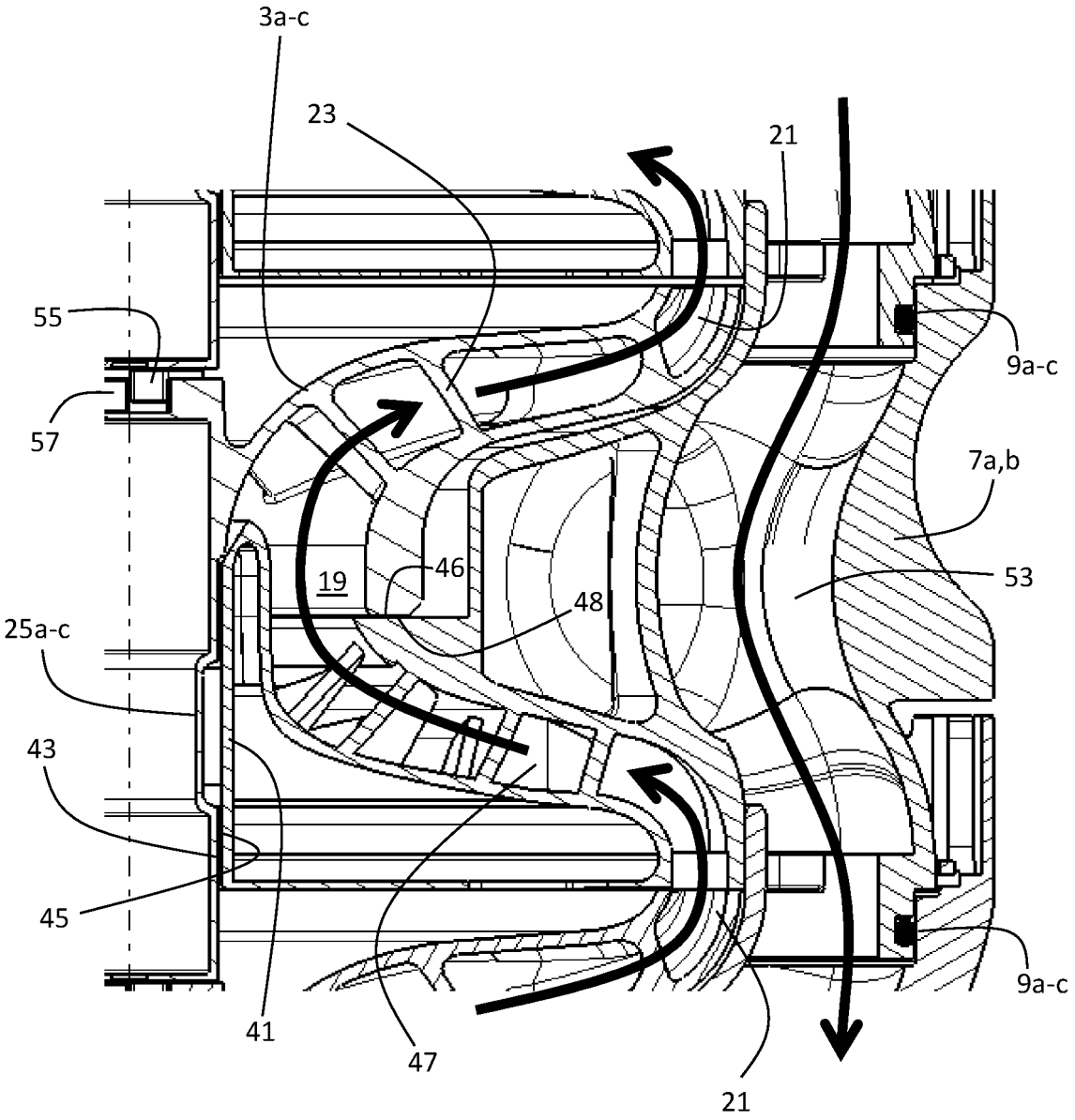
FIG. 5 is a partial longitudinal sectional view of a pump stage of an embodiment of a centrifugal pump assembly according to the present disclosure.

In FIG. 5, the flow of the pumped fluid is indicated by large arrows. As can be seen, each pump stage housing segment 7*a,b* defines a guide passage 47 for receiving pumped fluid from an impeller outlet 21 and guiding the pumped fluid radially inward along an S-shaped path towards an impeller inlet 19 of the subsequent impeller 3*a-c*. The impeller outlet 21 faces away from the pump base 5 and an inlet of the guide passage 47 faces towards the pump base 5. Analogously, the impeller inlet faces away from the pump head 11 and an outlet of the guide passage faces away from the pump base 5. Thereby, the pumped fluid flows essentially axially (vertical) at the interfaces between the impeller 19 and the guide passage 47.

Each pump stage housing segment 7*a,b* also defines a section of the outlet fluid channel 53 through which the pumped fluid flows essentially downward towards the pump outlet 15. As shown in FIG. 5, the outlet fluid channel 53 has a wavy shape which may be optimised for fluid dynamic efficiency and/or structural integrity at the cost of minimal material and weight. Additive manufacturing of the pump stage housing segments 7*a,b* significantly increase the design freedom in this respect. The outlet fluid channel 53 may, however, have a different shape, e.g. a straight vertical shape, if that is more suitable for any reason.

Figure 6:
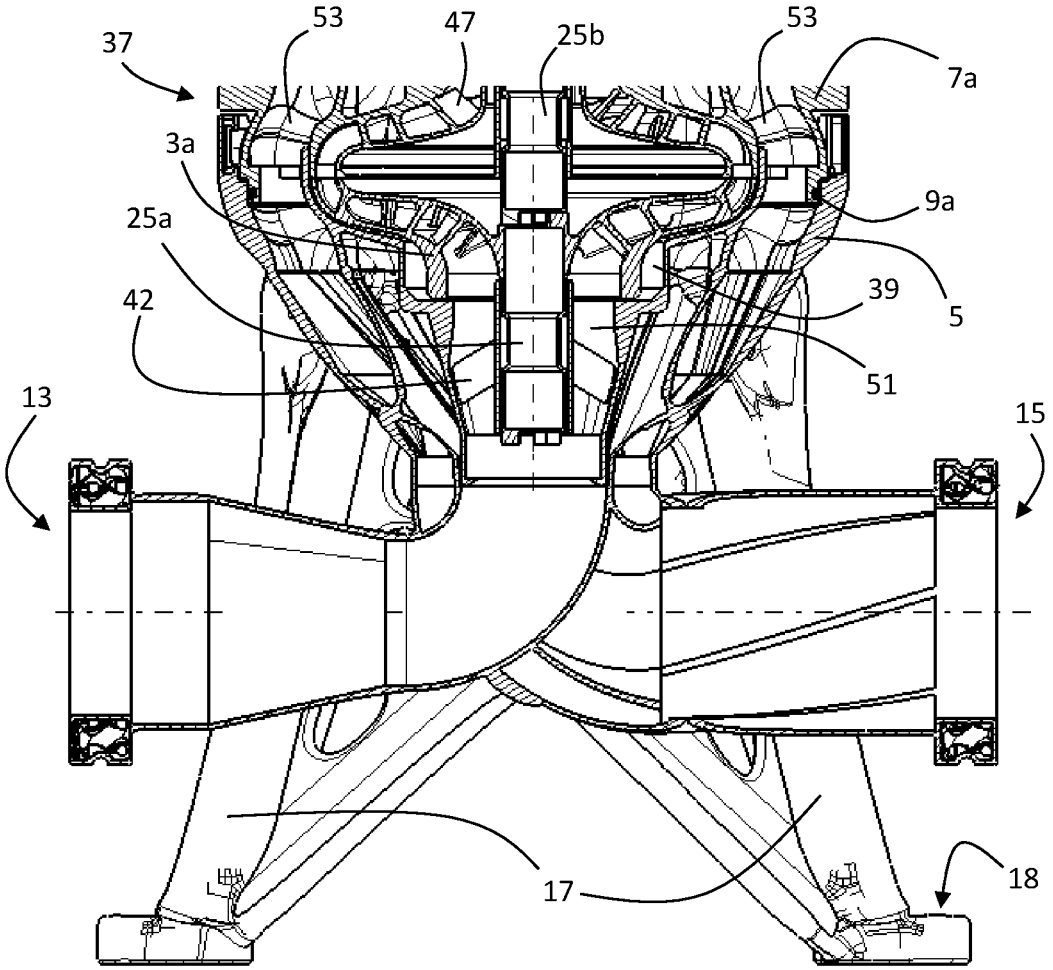
FIG. 6 is a longitudinal sectional view of a pump base of an embodiment of a centrifugal pump assembly according to the present disclosure.

FIG. 6 shows the pump base 5 in more detail. As already explained above, the pump base 5 functions partly as a pump housing for the first pump stage. Therefore, the pump base 5 comprises the impeller receptacle 39 that is open towards the (upper) pump base end 37. The first impeller 3*a* is completely received within the impeller receptacle 39 of the pump base 5. In other words, the pump base 5 completely surrounds the first impeller 3*a*. The tubular element 41 of the pump base 5 is arranged coaxially within the suction mouth 51 for receiving the rotor shaft segment 25*a* of the first impeller 3*a*. The tubular element 41 is supported within the suction eye 51 by radially extending webs 42. The tubular element 41 of the pump base 5 defines a static radial inner bearing surface 43. The static radial inner bearing surface 43 is in low-friction sliding contact with a corresponding rotating radial outer bearing surface 45 of the rotor shaft segment 25*a* of the first impeller 3*a*. Furthermore, the pump base 5 defines a static annular axial bearing surface 46 facing towards the pump head 11. The static axial bearing surface 46 is in low-friction sliding contact with a corresponding downward-facing, i.e. towards the pump base 5, rotating axial bearing surface 48 of the first impeller 3*a* (see FIGS. 3 and 4*b*).

Figure 7:
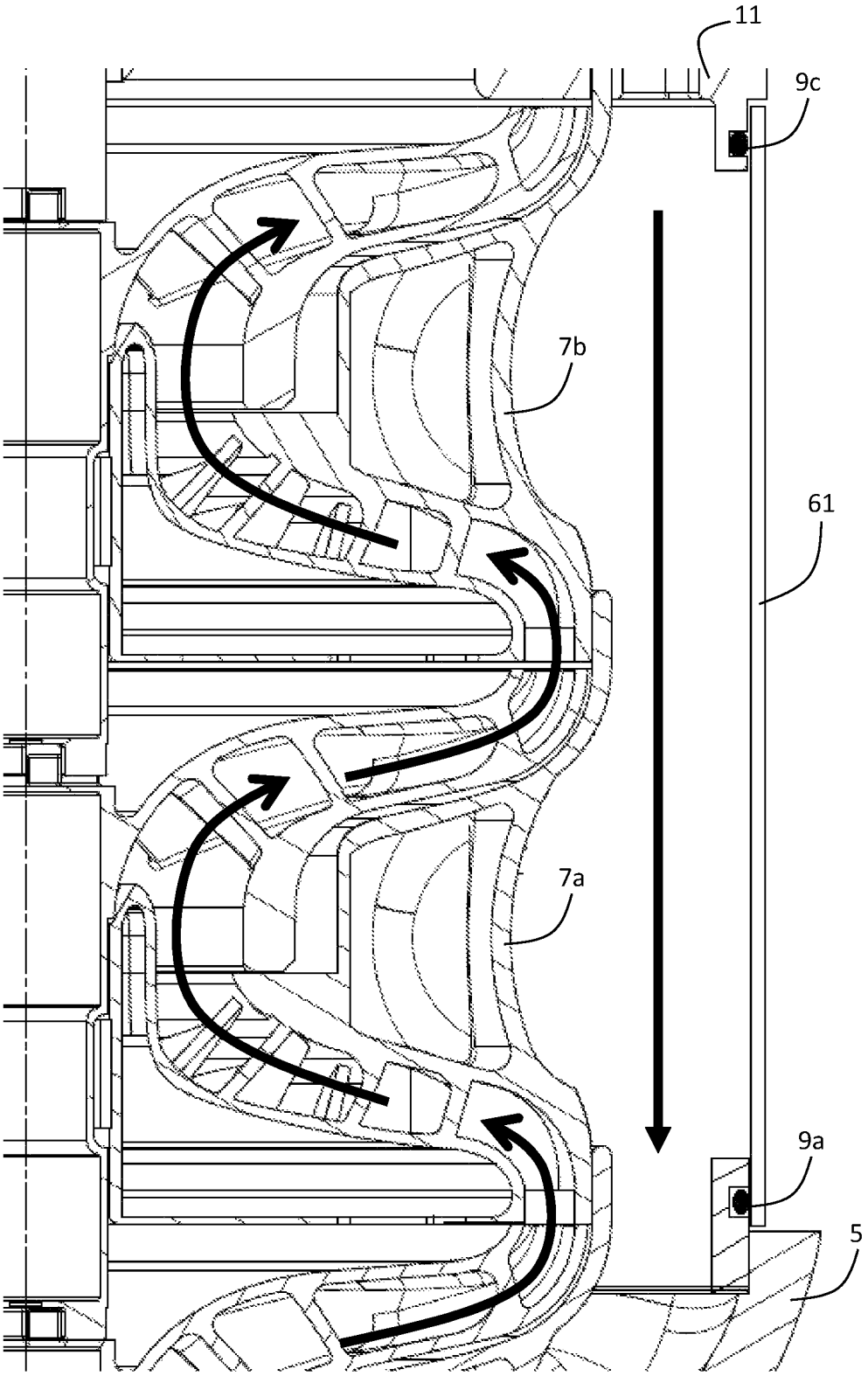
FIG. 7 is a partial longitudinal sectional view of two pump stages of an alternative embodiment of a centrifugal pump assembly according to the present disclosure.

FIG. 7 shows an embodiment, in which the pump stage housing segments 7*a,b* have a structure defining only a part of a wall section of the fluid outlet channel 53, so that the pumped fluid flows along an outer periphery of the pump stage housing segments 7*a,b* downwards towards the pump outlet 15. The centrifugal pump assembly 1 further comprises a fluid outlet channel sleeve 61 circumferentially enclosing the pump stage housing segments 7*a,b* in order to define the rest of the wall section of the fluid outlet channel 53, so that the pumped fluid flows along an inner surface of the fluid outlet channel sleeve 61, i.e. radially between the pump stage housing segment 7*a,b* and the fluid outlet channel sleeve 61, downwards towards the pump outlet 15. In other words, the part of the wall section defined by the pump stage housing segments 7*a,b* and the fluid outlet channel sleeve 61 complement each other to define the at least one fluid outlet channel 53. The rest of the embodiment is identical to the previously described embodiment of FIGS. 1 to 6.

The embodiment shown in FIG. 7 is particularly advantageous for centrifugal pump assemblies with many pump stages, because there is no sealing element 9*b* needed between the pump stage housing segments 7*a,b*. The first sealing element 9*a* may be used to seal a gap between the fluid outlet channel sleeve 61 and the pump base 5. Analogously, the (topmost) third sealing element 9*c* may be used to seal a gap between the fluid outlet channel sleeve 61 and the pump head 11. Thus, only two sealing elements 9*a,c* are needed here independent of the number of pump stages. The more pump stages there are, the more sealing elements 9*b* may be saved, which reduces the number of parts and the risk of a sealing leakage. It should be noted that the fluid outlet channel sleeve 61 does not pull the pump head 11 and the pump base 5 together. This is, as described for the embodiment of FIGS. 1 to 6, achieved by the mechanical coupling of the pump stage housing segments 7*a,b* to each other and to the pump base 5 and to the pump head 11, respectively.

Figure 8:
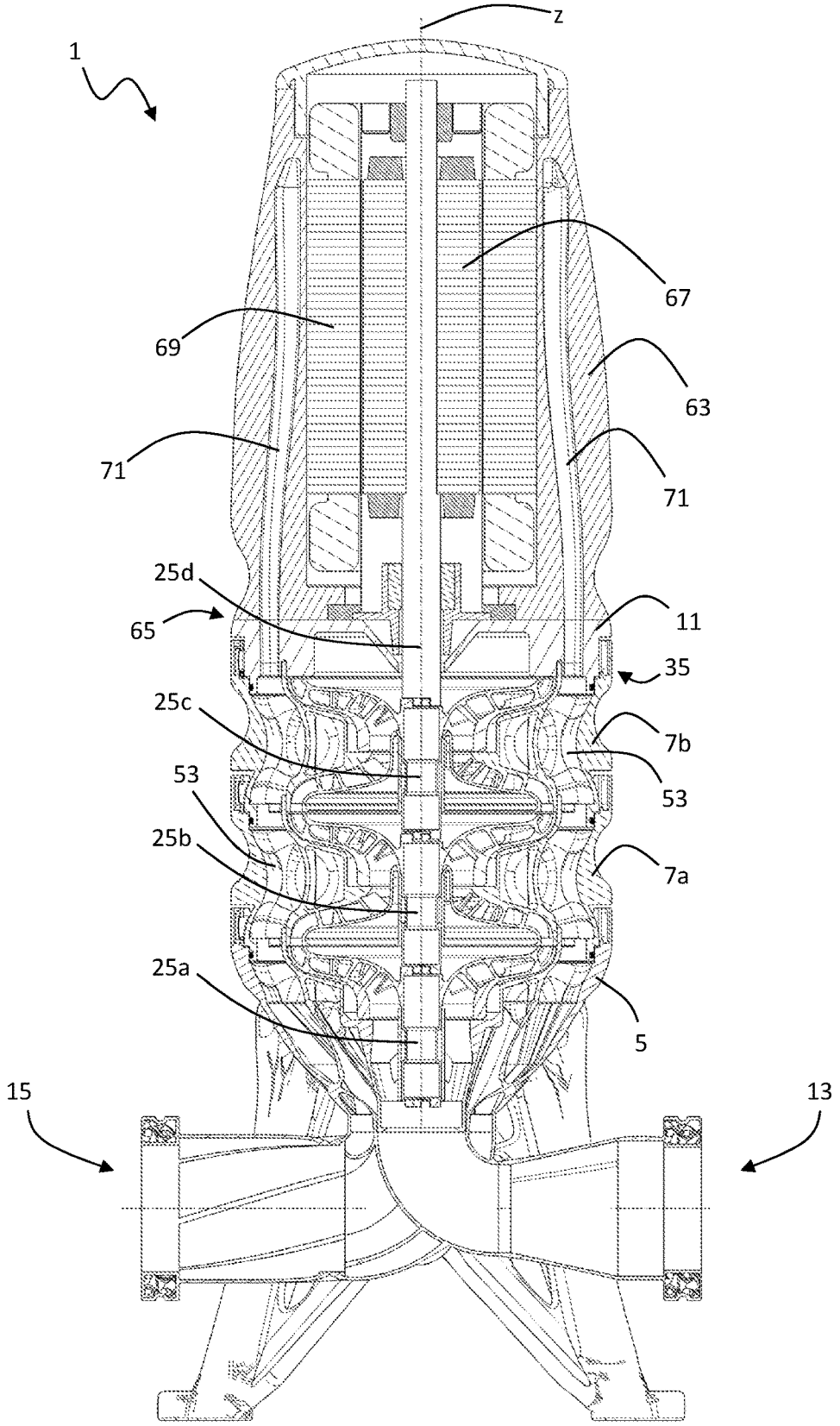
FIG. 8 is a longitudinal sectional view of an embodiment of a centrifugal pump assembly according to the present disclosure.

FIG. 8 shows an embodiment of a three-stage vertical centrifugal pump assembly 1 in a full longitudinal cut view showing particularly an embodiment of the pump head 11. The pump head 11 may be structurally integral with a motor housing 63 or connected to it as shown in FIG. 8. The pump head 11 is connected with its (lower) pump head end 35 to the (topmost) pump stage housing segment 7*b* and with an opposite pump head end 65 to the motor housing 63. The motor housing 63 encloses an electric motor, preferably a permanent-magnet synchronous motor (PMSM), comprising a rotor 67 being fixed to the (topmost) rotor shaft segment 25*d* and a stator 69 surrounding the rotor 67.

The motor housing 63 defines a reverse channel 71 for receiving pumped fluid from the last (topmost) impeller 3*c* and directs the pumped fluid to the section of the fluid outlet channel 53 defined by the (topmost) second pump stage housing segment 7*b* that is coupled to the pump head 11. The motor housing 63 functions as a heat sink being in thermal contact with heat-generating electric components of the motor or of control electronics for controlling the motor. In order to cool the motor housing 63 for improving heat dissipation, the reverse channel 71 extends through the motor housing 63 in thermal contact with heat-generating components of the motor, so that the pumped fluid cools the heat-generating components of the motor. Preferably, there is one reverse channel 71 provided for each fluid outlet channel 53, i.e. six reverse channels 71 in the shown embodiment. Each reverse channel 71 may follow a U-shaped path within the motor housing 63 extending essentially along the full axial length of the stator 69, wherein the reverse channel 71 comprises an upward section and a downward section. The longitudinal cut view of FIG. 8 only shows two downward sections of two of the reverse channels 71, because the upward sections and the other four reverse channels 71 are outside of the cutting plane. The downward sections of the reverse channels 71 feed the fluid outlet channels 53 to guide the pumped fluid downward towards the pump outlet 15.

Where, in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as optional, preferable, advantageous, convenient or the like are optional and do not limit the scope of the independent claims.

The above embodiments are to be understood as illustrative examples of the disclosure. It is to be understood that any feature described in relation to any one embodiment may be used alone, or in combination with other features described, and may also be used in combination with one or more features of any other of the embodiments, or any combination of any other of the embodiments. While at least one exemplary embodiment has been shown and described, it should be understood that other modifications, substitutions and alternatives are apparent to one of ordinary skill in the art and may be changed without departing from the scope of the subject matter described herein, and this application is intended to cover any adaptations or variations of the specific embodiments discussed herein.

In addition, "comprising" does not exclude other elements or steps, and "a" or "one" does not exclude a plural number. Furthermore, characteristics or steps which have been described with reference to one of the above exemplary embodiments may also be used in combination with other characteristics or steps of other exemplary embodiments described above. Method steps may be applied in any order or in parallel or may constitute a part or a more detailed version of another method step. It should be understood that there should be embodied within the scope of the patent warranted hereon all such modifications as reasonably and properly come within the scope of the contribution to the art. Such modifications, substitutions and alternatives can be made without departing from the spirit and scope of the disclosure, which should be determined from the appended claims and their legal equivalents.

LIST OF REFERENCE CHARACTERS

1 centrifugal pump assembly
3*a-c* impellers
5 pump base
7*a,b* pump stage housing elements
9*a-c* sealing elements
11 pump head
13 pump inlet
15 pump outlet
17 feet
18 openings
19 impeller inlet
21 impeller outlet
23 vanes
25*a-d* rotor shaft segments
27 first mechanical coupling
29 first axial segment end
31 second mechanical coupling
33 second axial segment end
35 pump head end
37 pump base end
39 impeller receptacle
41 tubular element
42 webs
43 static inner radial bearing surface
45 rotating outer radial bearing surface
46 static axial bearing surface
47 guide passage
48 rotating axial bearing surface
51 suction eye
53 fluid outlet channel
55 first axial end of a rotor shaft segment
57 second axial end of a rotor shaft segment
59 axial buffer room
61 fluid outlet channel sleeve
63 motor housing
65 pump head end
67 rotor
69 stator
71 reverse channel
z rotor axis

What is claimed is:

1. A centrifugal pump assembly comprising:

a pump head configured to connect to or be integral with a motor stool and/or a motor housing;

a pump base defining a pump inlet and a pump outlet;

at least one fluid outlet channel configured to guide pumped fluid from the pump head to the pump outlet;

at least two rotor shaft segments coaxially aligned and extending along a rotor axis, wherein each of the at least two rotor shaft segments comprises a first axial end facing away from the pump head and a second axial end facing away from the pump base;

one or more impellers, each of the one or more impellers having a structure defining at least one impeller fluid channel extending from an impeller inlet to an impeller outlet, wherein each of the one or more impellers is fixed to or structurally integral with one of the at least two rotor shaft segments, wherein the first axial end of one of the at least two rotor shaft segments comprises a positive fit coupling configured for coupling with the second axial end of another one of the at least two rotor shaft segments for torque transfer between the at least two rotor shaft segments; and one or more pump stage housing segments arranged between the pump base and the pump head, wherein each of the one or more pump stage housing segments have a structure defining a guide passage for receiving pumped fluid from the impeller outlet of one of the one or more impellers and for guiding pumped fluid to the impeller inlet of another one of the one or more impellers or to the pump head, wherein the one or more pump stage housing segments each have a structure defining at least a part of a wall section of the at least one fluid outlet channel, wherein the one or more pump stage housing segments each comprise a first mechanical coupling at a first axial segment end facing towards the pump base and a second mechanical coupling at a second axial segment end facing towards the pump head, wherein the one or more pump stage housing segments is coupled to the pump base or to another pump stage housing segment by the first mechanical coupling, and wherein the one or more pump stage housing segments is coupled to the pump head or to another pump stage housing segment by the second mechanical coupling.

2. The centrifugal pump assembly according to claim 1, wherein at least one of the one or more impellers is received within the pump base, wherein said at least one of the one or more impellers is rotatably arranged within the pump base.

3. The centrifugal pump assembly according to claim 1, wherein each of the one or more impellers and/or the at least two rotor shaft segments defines at least one rotating axial bearing surface facing towards the pump base arranged in sliding contact with a corresponding static axial bearing surface defined by one of the one or more pump stage housing segments or the pump base and facing towards the pump head.

4. The centrifugal pump assembly according to claim 1, wherein the positive fit coupling of the at least two rotor shaft segments is axially loose.

5. The centrifugal pump assembly according to claim 1, wherein each of the one or more impellers and/or the at least two rotor shaft segments defines at least one rotating radial bearing surface facing radially outward and arranged in sliding contact with a corresponding static radial bearing surface that is defined by one of the pump stage housing segments or the pump base and facing radially inward.

6. The centrifugal pump assembly according to claim 1, wherein at least one of the following has a single integral additively manufactured structure:

at least one of the one or more pump stage housing segments;

at least one of the one or more impellers;

the pump head; and the pump base.

7. The centrifugal pump assembly according to claim 1, wherein the one or more pump stage housing segments each have a structure defining the wall section of the at least one fluid outlet channel, wherein the wall section fully circumferentially encloses fluid pumped through the at least one fluid outlet channel.

8. The centrifugal pump assembly according to claim 1, further comprising a fluid outlet channel sleeve circumferentially enclosing the one or more pump stage housing segments, wherein the one or more pump stage housing segments each have a structure defining a part of the wall section of the at least one fluid outlet channel, wherein the part of the wall section and the fluid outlet channel sleeve complement each other to define the at least one fluid outlet channel.

9. The centrifugal pump assembly according to claim 1, wherein the first mechanical coupling is formed as a corresponding coupling counterpart to the second mechanical coupling for being releasably coupled to a second coupling of another pump stage housing segment.

10. The centrifugal pump assembly according to claim 1, wherein the first mechanical coupling and/or the second mechanical coupling of the one or more pump stage housing segments predefine one or more distinct rotational mounting positions of said one or more pump stage housing segments.

11. The centrifugal pump assembly according to claim 1, wherein the first mechanical coupling and the second mechanical coupling define corresponding coupling counterparts of a bayonet coupling.

12. The centrifugal pump assembly according to claim 8, further comprising at least one sealing element for sealing the at least one fluid outlet channel.

13. The centrifugal pump assembly according to claim 1, wherein the pump head defines a reverse channel for receiving pumped fluid from one of the one or more impellers and redirecting the pumped fluid to the at least one fluid outlet channel section of the one or more pump stage housing segments that is coupled to the pump head.

14. The centrifugal pump assembly according to claim 13, wherein the pump head is connected to or is integral with the motor housing and the reverse channel extends through the motor housing in thermal contact with heat-generating components of the motor, so that the pumped fluid cools the heat-generating components of the motor.

15. The centrifugal pump assembly according to claim 1, wherein an axial buffer room is provided between the first axial end of the rotor shaft segment and the second axial end of another one of the rotor shaft segments that is positively coupled thereto for torque transfer between said coupled rotor shaft segments.

16. The centrifugal pump assembly according to claim 15, wherein the axial buffer room is at least partly filled by a buffer medium.

17. The centrifugal pump assembly according to claim 1, wherein the pump base defines a fluid suction inlet channel extending from the pump inlet to a suction eye, wherein the suction eye is arranged coaxial with the rotor axis and laterally surrounds a rotor shaft segment of one of the one or more impellers.

18. The centrifugal pump assembly according to claim 17, wherein the pump base defines a tubular element arranged coaxially within the suction eye for receiving the rotor shaft segment of said impeller, wherein the tubular element provides at least one static inner radial bearing surface in sliding contact with a rotating outer radial bearing surface of the rotor shaft segment of said impeller.

19. The centrifugal pump assembly according to claim 1, wherein the centrifugal pump is free of at least one of:

a shaft extending from the pump head to the pump base; and tie rods or straps for holding the pump head and the pump base together.

20. The centrifugal pump assembly according to claim 1, wherein the impeller outlet faces away from the pump base and an inlet of the guide passage faces towards the pump base, wherein the inlet of the guide passage is arranged to receive pumped fluid from the impeller outlet.

21. The centrifugal pump assembly according to claim 1, wherein the one or more impellers comprises a first impeller and a second impeller, the first impeller and the second impeller being identical in shape, size and material.

22. The centrifugal pump assembly according to claim 1, wherein the one or more pump stage housing segments comprises a first pump stage housing segment and a second pump stage housing segment, the first pump stage housing segment and the second pump stage housing segment being identical in shape, size and material.

* * * * *